US010291990B2

(12) United States Patent
Salvatti et al.

(10) Patent No.: US 10,291,990 B2
(45) Date of Patent: May 14, 2019

(54) UNIBODY DIAPHRAGM AND FORMER FOR A SPEAKER

(71) Applicant: Apple Inc., Cupertino, CA (US)

(72) Inventors: Alexander V. Salvatti, Morgan Hill, CA (US); Matthew A. Donarski, San Francisco, CA (US); Paulina Mustafa, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 15/335,334

(22) Filed: Oct. 26, 2016

(65) Prior Publication Data

US 2018/0115830 A1 Apr. 26, 2018

(51) Int. Cl.

| | |
|---|---|
| ***H04R 1/00*** | (2006.01) |
| ***H04R 9/06*** | (2006.01) |
| ***H04R 7/12*** | (2006.01) |
| ***H04R 9/04*** | (2006.01) |
| ***H04R 9/02*** | (2006.01) |

(52) U.S. Cl.
CPC ..... *H04R 9/06* (2013.01); *H04R 7/12* (2013.01); *H04R 9/022* (2013.01); *H04R 9/04* (2013.01); *H04R 2499/11* (2013.01)

(58) Field of Classification Search
CPC combination set(s) only.
See application file for complete search history.

(56) References Cited

U.S. PATENT DOCUMENTS

| | | | | |
|---|---|---|---|---|
| 4,531,608 | A | 7/1985 | Heinz | |
| 4,591,667 | A | 5/1986 | Hino et al. | |
| 4,752,963 | A | 6/1988 | Yamazaki et al. | |
| 4,799,266 | A | 1/1989 | Sakamoto et al. | |
| 5,940,522 | A | 8/1999 | Cahill et al. | |
| 6,088,466 | A | 7/2000 | Proni | |
| 6,993,146 | B2 | 1/2006 | Sato | |
| 6,993,147 | B2 | 1/2006 | Godehard | |
| 7,185,735 | B2 * | 3/2007 | Sahyoun | H04R 7/122 181/147 |
| 7,286,681 | B2 | 10/2007 | Gerkinsmeyer | |

(Continued)

FOREIGN PATENT DOCUMENTS

| | | |
|---|---|---|
| DE | 3917477 | 12/1990 |
| EP | 1799011 | 6/2007 |

(Continued)

OTHER PUBLICATIONS

European Search Report (dated Jan. 30, 2012), Application No. 11188464.9-2225—Date Filed—Nov. 9, 2011, 6 pages.

(Continued)

*Primary Examiner* — Amir H Etesam
(74) *Attorney, Agent, or Firm* — Womble Bond Dickinson (US) LLP

(57) ABSTRACT

A unibody piston and former for a speaker. The unibody piston and former including a piston having a sound radiating portion and a transition portion radially outward to the sound radiating portion, the sound radiating portion and the transition portion having a first interior angle that is less than one-hundred and eighty degrees. The unibody piston and former further including a former extending from the transition portion, the former and the transition portion forming a second interior angle, and the former and the piston are a unibody structure.

26 Claims, 4 Drawing Sheets

(56) References Cited

U.S. PATENT DOCUMENTS

| | | | | |
|---|---|---|---|---|
| 7,505,603 | B2 | 3/2009 | Yoo | |
| 7,835,538 | B2 | 11/2010 | Inoue et al. | |
| 7,877,856 | B2 | 2/2011 | Fukuyama et al. | |
| 7,916,890 | B2 | 3/2011 | Irby et al. | |
| 8,009,857 | B2 | 8/2011 | Bohlender et al. | |
| 8,111,868 | B2 | 2/2012 | Kaiya | |
| 8,180,092 | B2 | 5/2012 | Grell et al. | |
| 8,290,199 | B2 | 10/2012 | Pircaro | |
| 8,325,968 | B2 | 12/2012 | Pan et al. | |
| 8,374,379 | B2 | 2/2013 | Proni | |
| 8,442,259 | B2 * | 5/2013 | Williamson | H04R 7/20 381/398 |
| 8,467,557 | B2 | 6/2013 | Miller et al. | |
| 8,520,886 | B2 | 8/2013 | Wilk | |
| 8,548,191 | B2 | 10/2013 | Stead | |
| 8,630,440 | B2 | 1/2014 | Dickie | |
| 9,143,866 | B2 * | 9/2015 | Trainer | H04R 9/045 |
| 9,247,348 | B2 | 1/2016 | Wilk | |
| 2001/0017928 | A1 | 8/2001 | Sugiyama et al. | |
| 2003/0068063 | A1 | 4/2003 | Usuki et al. | |
| 2007/0025587 | A1 | 2/2007 | Hlibowicki | |
| 2007/0140519 | A1 * | 6/2007 | Fukuyama | H04R 7/24 381/398 |
| 2008/0137901 | A1 | 6/2008 | Michno et al. | |
| 2008/0279415 | A1 | 11/2008 | Roemer et al. | |
| 2009/0116682 | A1 | 5/2009 | Suzuki et al. | |
| 2009/0226018 | A1 | 9/2009 | Nielsen et al. | |
| 2010/0215207 | A1 | 8/2010 | Funahashi | |
| 2010/0215209 | A1 | 8/2010 | Frasl | |
| 2010/0303278 | A1 * | 12/2010 | Sahyoun | H04R 9/043 381/398 |
| 2011/0150265 | A1 | 6/2011 | Pan | |
| 2013/0058519 | A1 | 3/2013 | Wilk | |
| 2013/0195311 | A1 | 8/2013 | Sahyoun | |
| 2014/0241566 | A1 | 8/2014 | Choi et al. | |

FOREIGN PATENT DOCUMENTS

| | | |
|---|---|---|
| EP | 1845750 | 10/2007 |
| TW | I245575 | 12/2005 |
| WO | WO 2011007403 A1 | 1/2011 |
| WO | WO-2011135291 | 11/2011 |

OTHER PUBLICATIONS

PCT International Search Report and Written Opinion (dated Mar. 2, 2012), International Application No. PCT/US2011/059808, International Filing Date—Nov. 8, 2011, 12 pages.

Non-Final Office Action (dated Dec. 28, 2012), U.S. Appl. No. 12/985,024, filed Jan. 5, 2011, First Named Inventor: Christopher Raymond Wilk, 13 pages.

CN First Office Action (dated Nov. 22, 2013), Application No. 201110433808.5, Date Filed—Nov. 11, 2011, 19 pages.

ROC (Taiwan) Search Report (dated Mar. 3, 2014), Patent Application No. 100141337, Date Filed—Nov. 11, 2011, 9 pages.

ROC (Taiwan) Office Action (dated Mar. 24, 2014), Patent Application No. 100141337, Date Filed—Nov. 11, 2011, 4 pages.

CN Second Office Action (dated Jul. 10, 2014), Application No. 201110433808.5, Date Filed—Nov. 11, 2011, 6 pages.

Non-Final Office Action (dated Nov. 24, 2014), U.S. Appl. No. 13/974,835, filed Aug. 23, 2013, First Named Inventor: Christopher Raymond Wilk, 13 pages.

EP Examination Report (dated Nov. 14, 2014), Application No. 11188464.9, Date Filed—Nov. 9, 2011, 6 pages.

Final Office Action (dated Jun. 12, 2015), U.S. Appl. No. 13/974,835, filed Aug. 23, 2013, First Named Inventor: Christopher Raymond Wilk, 16 pages.

"10" Aluminum Cone Musical Instrument Speaker", (Sep. 8, 2016).

* cited by examiner

UNIBODY DIAPHRAGM AND FORMER FOR A SPEAKER

FIELD

An embodiment of the invention is directed to a unibody diaphragm and former assembly for a speaker, more specifically, a thermally conductive unibody diaphragm and former that acts as a heat sink and has geometric stiffness for improved acoustic performance. Other embodiments are also described and claimed.

BACKGROUND

In modern consumer electronics, audio capability is playing an increasingly larger role as improvements in digital audio signal processing and audio content delivery continue to happen. There is a range of consumer electronics devices that are not dedicated or specialized audio playback devices such as smart phones and portable timepieces, yet can benefit from improved audio performance. These devices, however, often do not have sufficient space to house high fidelity speakers. This is also true for portable personal computers such as laptop, notebook, and tablet computers, and, to a lesser extent, desktop personal computers with built-in speakers. Such devices typically require speaker enclosures or boxes that have a relatively low rise (i.e. height as defined along the z-axis) and small back volume, as compared to, for instance, stand alone high fidelity speakers and dedicated digital music systems for handheld media players.

The drivers (speakers) for such devices therefore typically use a low profile diaphragm assembly, which is composed of a diaphragm or sound radiating surface (SRS), a voice coil and optional former or bobbin for connecting the voice coil to the SRS, and a suspension member for suspending the entire assembly from a frame. The voice coil causes the SRS to vibrate axially thereby creating pressure waves outside the driver enclosure. The suspension surrounds and suspends the SRS within the enclosure and allows it to vibrate axially. Each of these moving parts, however, have natural structural resonances that can be excited at certain frequencies, which may be different from one another. As a result, at certain frequencies the suspension member moves out of phase, or the SRS itself may move non-pistonically (so-called "break up frequencies". Such out of phase movements can result in an undesirable sound pressure output (i.e. drop or peak in pressure) at these resonant frequencies. In addition, the voice coil may generate a heat output that can cause a distortion in the acoustic output if not dissipated.

SUMMARY

An embodiment of the invention is a speaker assembly having a unibody piston (e.g., diaphragm) and former (e.g., bobbin). More specifically, the piston and former may be formed from a single piece of aluminum and therefore in addition to generating a sound output, serve as a heat sink for the voice coil. For example, the unibody design may result in about a 1 dB of extra acoustic output at full power. In addition, the unibody piston and former structure may have two bends (e.g., two angles) that are calibrated to reduce a stress of the structure both during the initial forming operation and during use of the speaker, in comparison to a single bend design. For example, a first bend may be formed around a sound radiating portion of the piston and a second bend may be formed between the piston and the vertically extending former. In addition to reducing stress, the double bend design may increase a geometric stiffness of the piston in comparison to one having only a single angle. This, in turn, can result in a higher break-up frequency, allowing the driver to have a uniform acoustic output up to a higher frequency.

More specifically, an embodiment of the invention is a speaker assembly having a unibody piston and former. The unibody piston and former may include a piston having a sound radiating portion and a transition portion radially outward to the sound radiating portion. The sound radiating portion and the transition portion may form a first interior angle that is less than one-hundred and eighty degrees. In addition, a former may extend from the transition portion, and the former and the transition portion may form a second interior angle. The former and the piston may be a unibody structure. In some embodiments, an interior surface of the sound radiating portion and an interior surface of the transition portion form the first interior angle, and the interior surfaces share a same acoustic volume as the former when the unibody piston and former are coupled to a speaker frame. In some cases, the sound radiating portion has a substantially curved, concave shape. In other embodiments, the sound radiating portion has a cone shape or a substantially planar profile. In addition, the transition portion may have a downward slope in a direction of the former. In some embodiments, the first interior angle is greater than ninety degrees. In addition, the second interior angle may be between ninety degrees and one-hundred and eighty degrees. The piston may be substantially horizontally oriented and the former is substantially vertically oriented. In some embodiments, the first interior angle and the second interior angle in combination geometrically stiffen the piston so that it has a stiffness greater than a piston having a single angle formed therein. In some cases, the transition portion includes a substantially planar exterior surface, and a suspension member is attached to the exterior surface and couples the unibody piston and former to a frame. The piston and the former may be made of a thermally conductive material suitable for transferring a heat generated by a voice coil attached to the former, to the piston and dissipating the heat away from the piston. For example, the piston and former may be made of a material selected from aluminum, titanium, stainless steel or magnesium alloy.

Another embodiment of the invention is a unibody piston and former including a piston having a first portion for radiating sound and a second portion that extends radially outward to the first portion. The first portion and the second portion may form a first angle that is less than one-hundred and eighty degrees. The former may extend axially downward from the second portion and form a second angle that is greater than ninety degrees. In addition, the former and the piston are formed of a same material. In some embodiments, the first angle is an interior angle formed by a curved interior surface of the first portion and a substantially planar interior surface of the second portion. In some cases, the first angle is between ninety degrees and one-hundred and fifty degrees and the second angle is between one-hundred degrees and one-hundred and sixty degrees. The piston and the former may include a thermally conductive material suitable for transferring and dissipating heat. In addition, the unibody piston and former may include a suspension member directly attached to the second portion and suspending the piston and the former from a frame, a voice coil positioned around the former and a magnet assembly having a magnetic gap within which the voice coil is positioned, and wherein the magnet assembly comprises a recessed portion that is aligned with the first portion.

Another embodiment of the invention is directed to a speaker assembly including a frame and a magnet assembly coupled to the frame, the magnet assembly forming an air gap through which a magnetic flux is directed. In addition, the assembly may include a one-piece structure having a horizontally oriented piston positioned over the magnet assembly and a vertically oriented former that extends into the air gap formed by the magnet assembly, and at least one interior angle formed between the piston and the former is greater than ninety degrees. The assembly may also include a voice coil coupled to the former a suspension member that couples the one-piece structure to the frame to allow a substantially vertical movement of the piston relative to the frame. The at least one interior angle may be a first interior angle formed between a sound radiating portion and a sloped perimeter portion of the piston. In addition, a second interior angle is formed between the sloped perimeter portion of the piston and the former, and the second interior angle is between ninety degrees and one-hundred and sixty degrees. The magnet assembly may include a recessed region that is aligned with a sound radiating portion of the piston. The magnet assembly may include an opening that is aligned with a sound radiating portion of the piston. In addition, the one-piece structure may be formed of a thermally conductive material and is operable to dissipate a heat generated by the voice coil. Still further, the at least one interior angle geometrically increases a stiffness of the piston in comparison to a piston without an interior angle greater than ninety degrees.

The above summary does not include an exhaustive list of all aspects of the present invention. It is contemplated that the invention includes all systems and methods that can be practiced from all suitable combinations of the various aspects summarized above, as well as those disclosed in the Detailed Description below and particularly pointed out in the claims filed with the application. Such combinations have particular advantages not specifically recited in the above summary.

BRIEF DESCRIPTION OF THE DRAWINGS

The embodiments are illustrated by way of example and not by way of limitation in the figures of the accompanying drawings in which like references indicate similar elements. It should be noted that references to "an" or "one" embodiment in this disclosure are not necessarily to the same embodiment, and they mean at least one.

DETAILED DESCRIPTION

In this section we shall explain several preferred embodiments of this invention with reference to the appended drawings. Whenever the shapes, relative positions and other aspects of the parts described in the embodiments are not clearly defined, the scope of the invention is not limited only to the parts shown, which are meant merely for the purpose of illustration. Also, while numerous details are set forth, it is understood that some embodiments of the invention may be practiced without these details. In other instances, well-known structures and techniques have not been shown in detail so as not to obscure the understanding of this description.

The terminology used herein is for the purpose of describing particular embodiments only and is not intended to be limiting of the invention. Spatially relative terms, such as "beneath", "below", "lower", "above", "upper", and the like may be used herein for ease of description to describe one element's or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (e.g., rotated 90 degrees or at other orientations) and the spatially relative descriptors used herein interpreted accordingly.

As used herein, the singular forms "a", "an", and "the" are intended to include the plural forms as well, unless the context indicates otherwise. It will be further understood that the terms "comprises" and/or "comprising" specify the presence of stated features, steps, operations, elements, and/or components, but do not preclude the presence or addition of one or more other features, steps, operations, elements, components, and/or groups thereof.

The terms "or" and "and/or" as used herein are to be interpreted as inclusive or meaning any one or any combination. Therefore, "A, B or C" or "A, B and/or C" mean "any of the following: A; B; C; A and B; A and C; B and C; A, B and C." An exception to this definition will occur only when a combination of elements, functions, steps or acts are in some way inherently mutually exclusive.

Figure 1:
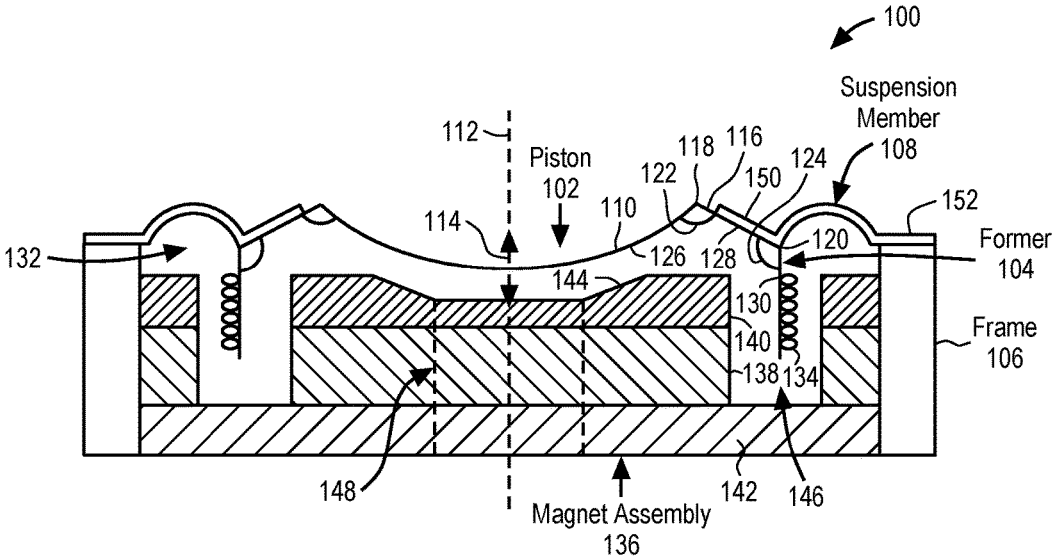
FIG. 1 illustrates a cross-sectional side view of one embodiment of a speaker assembly.

FIG. 1 illustrates a cross-sectional side view of one embodiment of a speaker assembly. Speaker assembly 100 may, for example, be any type of an electric-to-acoustic transducer having a sound radiating member or diaphragm and circuitry configured to produce a sound in response to an electrical audio signal input (e.g., a loudspeaker). The speaker assembly 100 may, for example, be part of a speaker enclosure or box whose speaker back volume is considered to be relatively small, for example, in a range of about 0.5 cubic cm to 10 cubic cm. The concepts described here, however, need not be limited to speaker enclosures whose back volume is in that range.

Speaker assembly 100 may include a unibody structure including a piston 102 and a former 104 which are suspended from a frame 106 by suspension member 108. The piston 102 and former 104 are considered a "unibody" structure in that they are inseparable portions of a one-piece, integrally formed structure. For example, piston 102 and former 104 may be manufactured from a sheet of material that is, for example, stamped or pressed, to form portions of the sheet into the shape of piston 102 and former 104.

Piston 102 may be a horizontally extending sound radiating member that vibrates and produces sound in response to an electrical audio signal input. Piston 102 may therefore also be understood as referring to a speaker diaphragm, as this term is commonly used in the context of speakers. More specifically, piston 102 may include a sound radiating portion 110 that can vibrate or otherwise move in an axial direction (along axis 112) to generate a sound output. For example, sound radiating portion 110 vibrates or moves in a substantially up and down or forward-backward direction, as illustrated by arrows 114. Sound radiating portion 110 may, in some embodiments, have a curved or concave shape with the curve extending in a downward direction, as shown in FIG. 1. In other embodiments, sound radiating portion 110 may be substantially flat (see FIG. 2) or be in the shape of a cone, or have a v-shaped profile (see FIG. 3). In each embodiment, however, it should be recognized that sound radiating portion 110 does not curve, or otherwise extend in an upward direction, such that a relatively low z-height profile is maintained.

Piston 102 may also include a perimeter portion 116 that is radially outward to sound radiating portion 110. Perimeter portion 116 may be a substantially flat region around sound radiating portion 110, and in some cases, may have a slope opposite to that of sound radiating portion 110. For example, in FIG. 1, sound radiating portion 110 has an upward slope at the end near perimeter portion 116, while perimeter portion 116 slopes downward toward former 104. Similar to sound radiating portion 110, perimeter portion 116 is intended to vibrate in phase along with portion 110, but perimeter portion 116 also serves as a transitional region between sound radiating portion 110, former 104 and suspension member 108, and helps to geometrically stiffen piston 102 and relieve stress. In particular, perimeter portion 116 extends between sound radiating portion 110 and former 104 and forms a first ridge or bend 118, having a first interior angle 122, with sound radiating portion 110. Perimeter portion 116 also forms a second ridge or bend 120, having a second interior angle 124, with former 104. It should be understood that the "interior angle" is the angle formed by the interior surfaces 126, 128 and 130 of the sound radiating portion 110, perimeter portion 116 and former 104, respectively. In other words, the interior surfaces (as opposed to exterior surfaces) of sound radiating portion 110, perimeter portion 116 and former 104 which share, or are otherwise within, a back volume chamber 132 of the speaker assembly 100.

The first bend 118 and second bend 120 are calibrated to increase a geometric stiffness of piston 102 (in comparison to a piston with no bend or only a single bend), and also help reduce stress on the unibody structure during manufacturing and operation. In particular, it has been found that when at least one of first bend 118 or second bend 120 have interior angles 122 and 124, respectively, that are greater than ninety degrees and less than one-hundred and eighty degrees, one or more of these desired effects are achieved. For example, first bend 118 may have an interior angle 122 that is between about ninety degrees and one-hundred and eighty degrees, or between about ninety degrees and one-hundred and fifty degrees, for example, about one-hundred and forty degrees plus/minus five degrees. Second bend 120 may have an interior angle 124 that is between ninety degrees and one-hundred and eighty degrees, or between one-hundred degrees and one-hundred and sixty degrees, for example, about one-hundred and ten degrees plus/minus five degrees.

It should be understood that the degree of interior angles 122 and 124 may be the same or different, however, it is critical that at least one of the interior angles, and preferably both, be greater than ninety degrees in order to achieve the desired level of geometric stiffness and/or stress reduction. An additional degree of freedom is the corner radii selected for the bends 118 and 120. In general, larger corner radii will lead to lower stress concentrations, and each material choice may have a different minimum radius needed to ensure the stresses are low enough to avoid failure. For example, at certain frequencies, typical speaker diaphragms may experience a breakup mode in which the diaphragm components move out of phase with one another and therefore a decrease in sound pressure output from the speaker at the breakup frequency may occur. By geometrically stiffening the area around sound radiating portion 110 with first bend 118 having interior angle 122 greater than ninety degrees, this break up frequency can be increased to a frequency that is above the working range of the speaker. Since the break up frequency is above the intended working range of the speaker, any undesirable impact in sound output from the speaker due to the break up frequency will go substantially unnoticed by the user. For example, in some embodiments where the working range of the speaker is from about 0.02 kHz to about 20 kHz, the first and second bends 118, 120 are configured to increase the break up frequency to a frequency greater than 20 kHz.

Returning now to the remaining portion of the unibody structure, namely former 104, former 104 may be a voice coil former (also known as a bobbin) around which voice coil 134 is wound. Former 104 may be a substantially vertically oriented structure, which extends in a substantially downward or axial direction from the perimeter portion 116 of piston 102. In this aspect, former 104 may be considered as being below piston 102 and, in some embodiments, confined to an area that is within a footprint of piston 102. In addition, although not shown, voice coil 134 may have electrical connections to a pair of terminals through which an input audio signal is received, in response to which voice coil 134 produces a changing magnetic field that interacts with the magnetic field produced by magnet assembly 136 for driving speaker assembly 100. In addition, it should be understood that because former 104 is integrally formed with piston 102, it eliminates the need to glue the former 104 to the piston 102. This, in turn, provides the advantage of a more efficient way to couple the coil force to the air and leads to a smoother acoustic output to a higher frequency.

In addition, the unibody piston 102 and former 104 may be made of a thermally conductive material and can therefore also serve as a heat sink for the voice coil 134. For example, piston 102 and former 104 may be stamped from a single piece of a thermally conductive material such as aluminum. The aluminum within former 104 will, in turn, transfer the heat generated by the surrounding voice coil 134 to piston 102, where it is then dissipated away from piston 102 as piston 102 vibrates. It should be understood, however, that aluminum is just one exemplary material that could be used to form piston 102 and former 104, and that other materials such as titanium, stainless steel, an aluminum alloy or a magnesium alloy, are also contemplated. In addition, in some embodiments, the unibody piston 102 and former 104 are formed from a sheet of material with an overall thickness of from about 25 to 75 microns.

The entire unibody structure, including piston 102 and former 104, may be suspended within frame 106 by suspension member 108. In this aspect, suspension member 108 may be a compliant member that allows for the substantially vertical movement of piston 102. Suspension member 108 may, in one embodiment, have one side 150 that is directly attached to an exterior surface of perimeter portion 116 and another side 152 that is attached to frame 106. In this aspect, perimeter portion 116 may have a surface area or length that is particularly suited for attachment of suspension member 108 thereto. For example, perimeter portion 116 may have a surface area or length sufficient to provide enough area to glue suspension member 108 directly thereto with a sufficient bond strength, and so that the load is spread and the adhesive (e.g., glue) will not overheat.

Speaker assembly 100 may further include a magnet assembly 136 mounted to frame 106. In this embodiment, magnet assembly 136 includes a permanent magnet 138 sandwiched by a ferromagnetic top plate 140 and a bottom plate 142. Magnet assembly 136 further includes an air gap 146 through which a magnetic flux is directed. The former 104 with voice coil 134 attached thereto is in turn positioned within air gap 146. In addition, in some embodiments, top plate 140 may include a recessed region 144. Recessed region 144 may be aligned with sound radiating portion 110 and provide more space between piston 102 and magnet assembly 136 for vibration of piston 102. Recessed region 144 is located in an area with low magnetic flux density, which provides space for the curved piston 102 while having negligible impact on magnetic efficiency For example, in some embodiments, recessed region 144 may have a similar profile to that of the sound radiating portion 110 (e.g., curved or concave shape). Still further, it is contemplated that in some embodiments, an optional opening (illustrated by dashed line 148) may be formed through the portion of magnet assembly 136 below sound radiating portion 110. The opening may further accommodate excursion of piston 102, while also serving as a means for acoustic venting.

Figure 2:
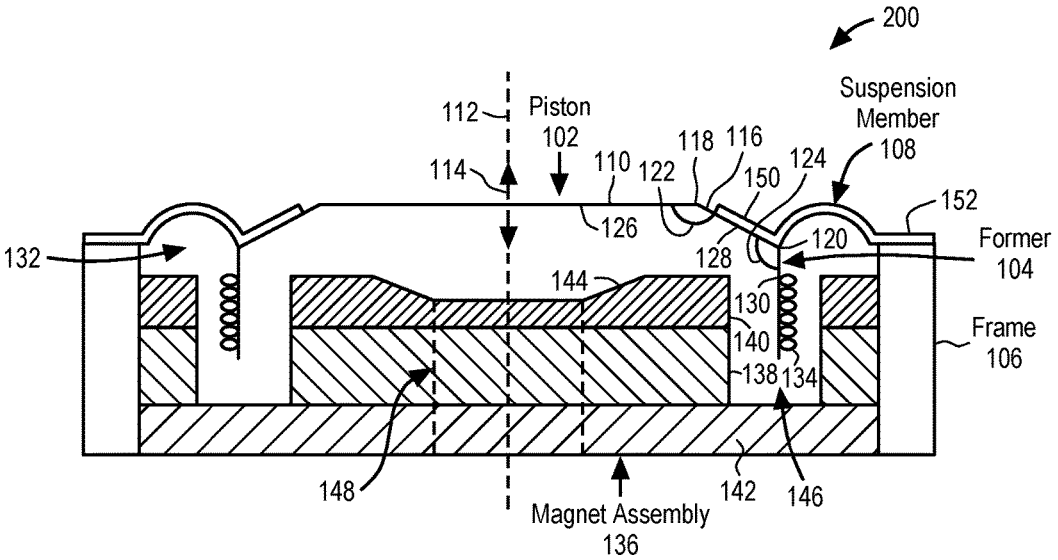
FIG. 2 illustrates a cross-sectional side view of another embodiment of a speaker assembly.

FIG. 2 illustrates a cross-sectional side view of another embodiment of a speaker assembly. Speaker assembly 200 is substantially similar to speaker assembly 100 described in reference to FIG. 1, and includes similar features that will therefore not be repeated here. In this embodiment, however, sound radiating portion 110 of piston 102 has a substantially planar profile, instead of the concave or curved profile of FIG. 1. In other words, sound radiating portion 110 is horizontally extending and substantially entirely within a single plane. In this embodiment, the first interior angle 122 of first bend 118 and second interior angle 124 of second bend 120 may still be between ninety degrees and one-hundred and eighty degrees, as previously discussed, but first interior angle 122 may be larger than that of FIG. 1 since there is no slope to the portion of sound radiating portion 110 that adjoins perimeter portion 116.

Figure 3:
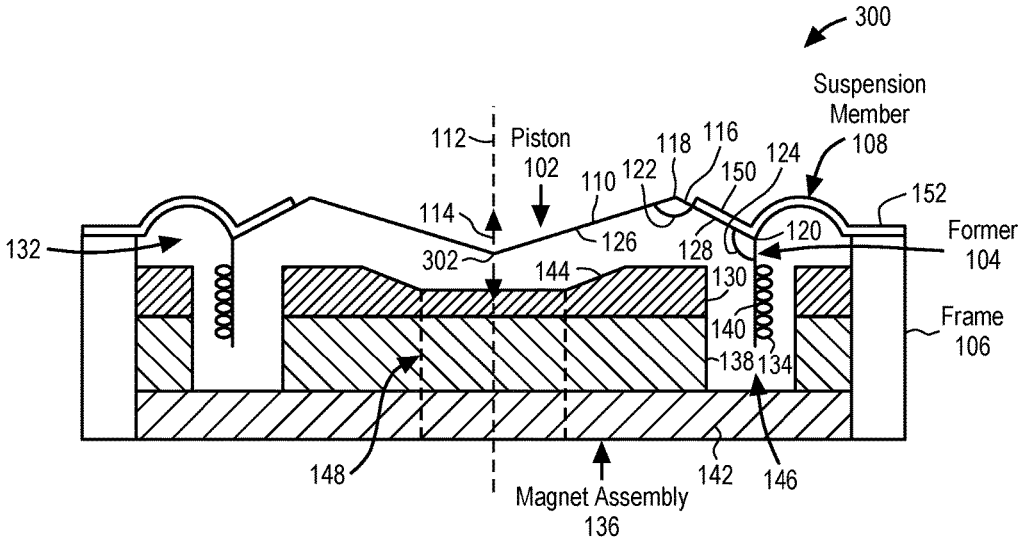
FIG. 3 illustrates a cross-sectional side view of another embodiment of a speaker assembly.

FIG. 3 illustrates a cross-sectional side view of another embodiment of a speaker assembly. Speaker assembly 300 is substantially similar to speaker assembly 100 described in reference to FIG. 1, and includes similar features that will therefore not be repeated here. In this embodiment, however, sound radiating portion 110 of piston 102 has a substantially cone or v-shaped profile, instead of the concave or curved profile of FIG. 1. In other words, sound radiating portion 110 includes slopes down to a vertex 302 which is closer to magnet assembly 136 than the ends of sound radiating portion 110 which form first bend 118. In this embodiment, the first interior angle 122 of first bend 118 and second interior angle 124 of second bend 120 may still be between ninety degrees and one-hundred and eighty degrees, as previously discussed, but first interior angle 122 may, in some cases, be smaller than that of FIG. 1 depending on the slope of sound radiating portion 110. Though FIG. 3 is shown with a sharp vertex 302, the vertex may optionally be radiused to avoid stress concentrations.

Figure 4A:
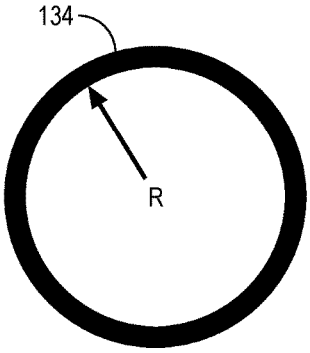
FIG. 4A illustrates top plan views of a voice coil that may be used in any of the speaker assemblies of FIG. 1 to FIG. 3.
Figure 4B:
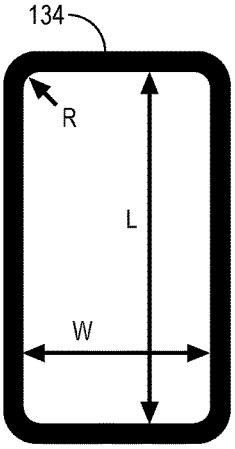
FIG. 4B illustrates top plan views of a voice coil that may be used in any of the speaker assemblies of FIG. 1 to FIG. 3.
Figure 4C:
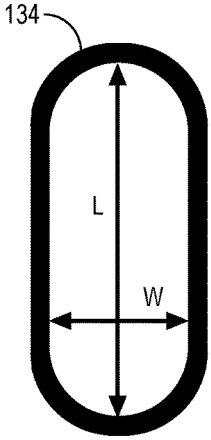
FIG. 4C illustrates top plan views of a voice coil that may be used in any of the speaker assemblies of FIG. 1 to FIG. 3.

FIG. 4A to FIG. 4C illustrate top plan views of various voice coil shapes that may be used in any of the speaker assemblies previously discussed in reference to FIG. 1 to FIG. 3. Representatively, FIG. 4A illustrates a top plan view of voice coil 134 having a round shape and a corner radii R. In other words, an axially symmetric voice coil which could be used in an axially symmetric transducer. FIG. 4B illustrates a top plan view of voice coil 134 having a rectangular shape in which the length (L) is longer than the width (W) as shown. FIG. 4C illustrates a top plan view of voice coil 134 having a racetrack shape. Similar to FIG. 4B, the length (L) is longer than the width (W). It should be understood, however, that other shapes may also be used, for example, a square shape. As previously discussed, a larger corner radii will lead to lower stress concentrations. Thus, for example, a round voice coil such as that shown in FIG. 4A will have the largest radii and therefore may have the lowest stress concentration of the various shapes. In addition, although not shown, in some embodiments, the corresponding former and piston will have a similar profile.

Figure 5:
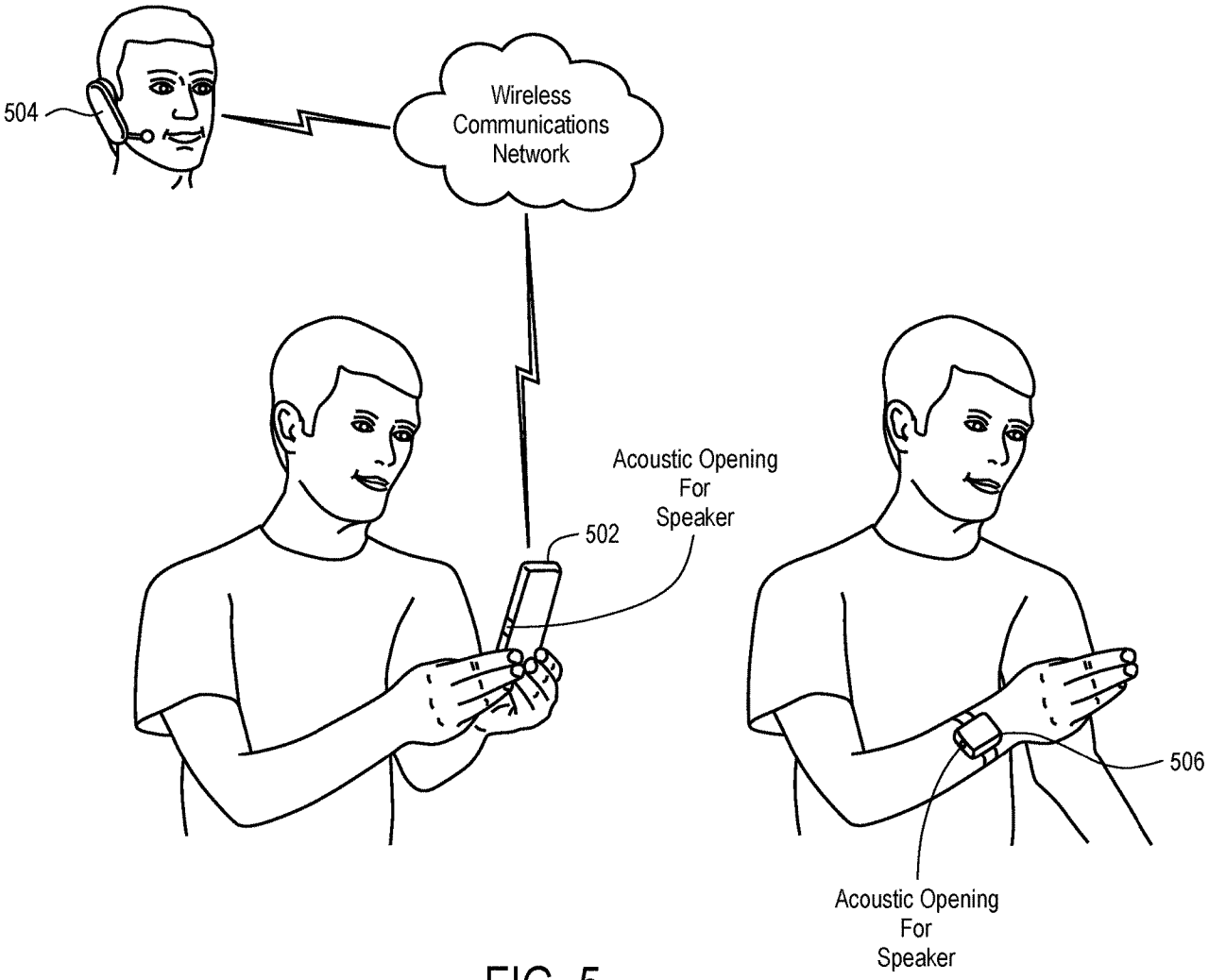
FIG. 5 illustrates one embodiment of a simplified schematic view of embodiments of electronic devices in which the speaker assembly of FIG. 1 may be implemented.

FIG. 5 illustrates one embodiment of a simplified schematic view of embodiments of electronic devices in which a speaker assembly, such as that described herein, may be implemented. As seen in FIG. 5, the speaker may be integrated within a consumer electronic device 502 such as a smart phone with which a user can conduct a call with a far-end user of a communications device 504 over a wireless communications network; in another example, the speaker may be integrated within the housing of a portable timepiece 506. These are just two examples of where the transducer described herein may be used, it is contemplated, however, that the speaker may be used with any type of electronic device in which a speaker is desired, for example, a tablet computer, a computing device or other display device.

Figure 6:
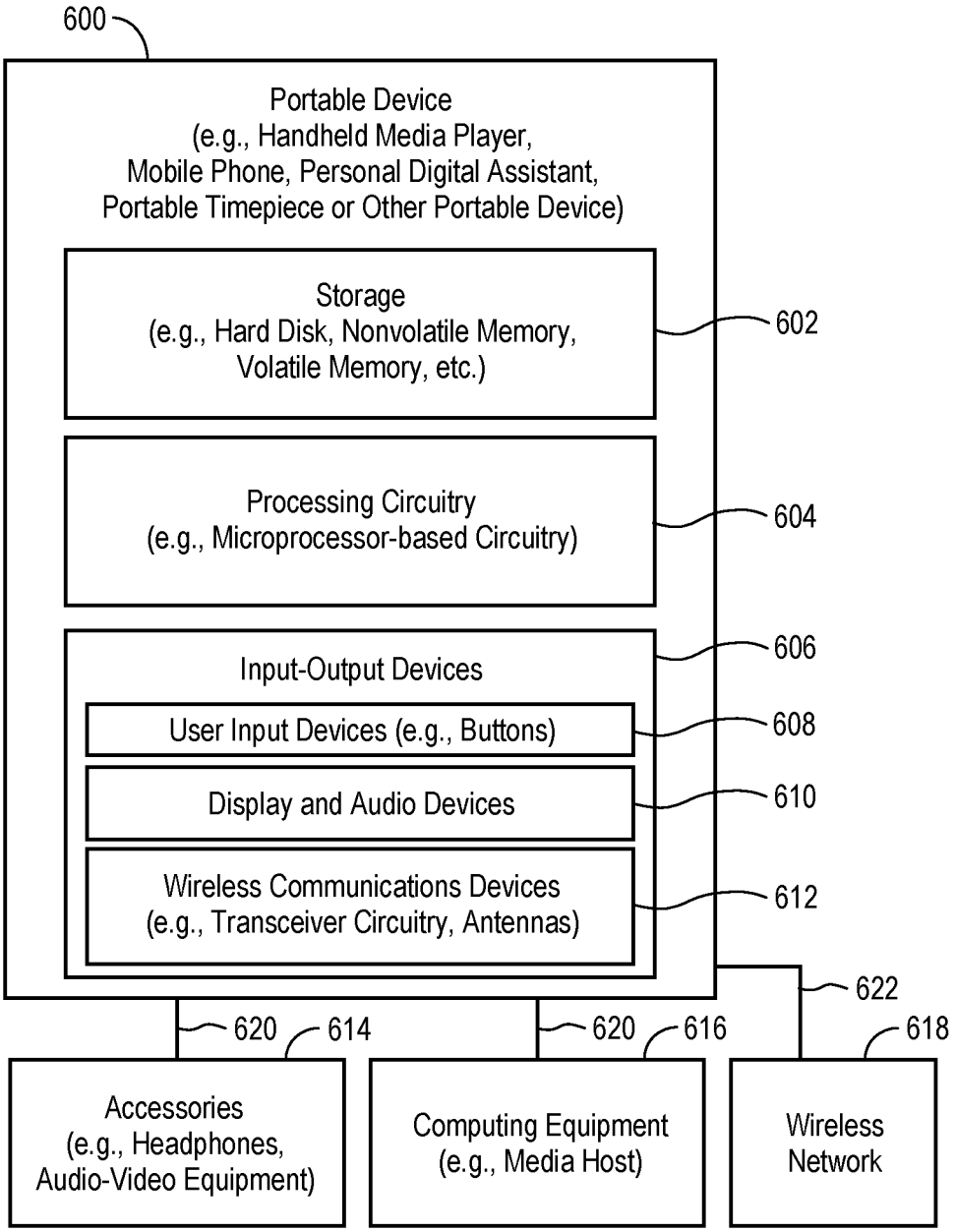
FIG. 6 illustrates a block diagram of one embodiment of an electronic device within which the speaker assembly of FIG. 1 may be implemented.

FIG. 6 illustrates a block diagram of one embodiment of an electronic device within which the previously discussed speaker may be implemented. As shown in FIG. 6, device 600 may include storage 602. Storage 602 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 604 may be used to control the operation of device 600. Processing circuitry 604 may be based on a processor such as a microprocessor and other suitable integrated circuits. With one suitable arrangement, processing circuitry 604 and storage 602 are used to run software on device 600, such as internet browsing applications, voice-over-internet-protocol (VOIP) telephone call applications, email applications, media playback applications, operating system functions, etc. Processing circuitry 604 and storage 602 may be used in implementing suitable communications protocols. Communications protocols that may be implemented using processing circuitry 604 and storage 602 include internet protocols, wireless local area network protocols (e.g., IEEE 802.11 protocols—sometimes referred to as Wi-Fi®), protocols for other short-range wireless communications links such as the Bluetooth® protocol, protocols for handling 3G or 4G communications services (e.g., using wide band code division multiple access techniques), 2G cellular telephone communications protocols, etc.

To minimize power consumption, processing circuitry 604 may include power management circuitry to implement power management functions. For example, processing circuitry 604 may be used to adjust the gain settings of amplifiers (e.g., radio-frequency power amplifier circuitry) on device 600. Processing circuitry 604 may also be used to adjust the power supply voltages that are provided to portions of the circuitry on device 600. For example, higher direct-current (DC) power supply voltages may be supplied to active circuits and lower DC power supply voltages may be supplied to circuits that are less active or that are inactive. If desired, processing circuitry 604 may be used to implement a control scheme in which the power amplifier circuitry is adjusted to accommodate transmission power level requests received from a wireless network.

Input-output devices 606 may be used to allow data to be supplied to device 600 and to allow data to be provided from device 600 to external devices. Display screens, microphone acoustic ports, speaker acoustic ports, and docking ports are examples of input-output devices 606. For example, input-output devices 606 can include user input-output devices 608 such as buttons, touch screens, joysticks, click wheels, scrolling wheels, touch pads, key pads, keyboards, microphones, cameras, etc. A user can control the operation of device 600 by supplying commands through user input devices 608. Display and audio devices 610 may include liquid-crystal display (LCD) screens or other screens, light-emitting diodes (LEDs), and other components that present visual information and status data. Display and audio devices 610 may also include audio equipment such as speakers and other devices for creating sound. Display and audio devices 610 may contain audio-video interface equipment such as jacks and other connectors for external headphones and monitors.

Wireless communications devices 612 may include communications circuitry such as radio-frequency (RF) transceiver circuitry formed from one or more integrated circuits, power amplifier circuitry, passive RF components, antennas, and other circuitry for handling RF wireless signals. Wireless signals can also be sent using light (e.g., using infrared communications). Representatively, in the case of a speaker acoustic port as shown in FIG. 5, the speaker may be associated with the port and be in communication with an RF antenna for transmission of signals from the far end user to the speaker.

Returning to FIG. 6, device 600 can communicate with external devices such as accessories 614, computing equipment 616, and wireless network 618 as shown by paths 620 and 622. Paths 620 may include wired and wireless paths. Path 622 may be a wireless path. Accessories 614 may include headphones (e.g., a wireless cellular headset or audio headphones) and audio-video equipment (e.g., wireless speakers, a game controller, or other equipment that receives and plays audio and video content), a peripheral such as a wireless printer or camera, etc.

Computing equipment 616 may be any suitable computer. With one suitable arrangement, computing equipment 616 is a computer that has an associated wireless access point (router) or an internal or external wireless card that establishes a wireless connection with device 600. The computer may be a server (e.g., an internet server), a local area network computer with or without internet access, a user's own personal computer, a peer device (e.g., another portable electronic device), or any other suitable computing equipment.

Wireless network 618 may include any suitable network equipment, such as cellular telephone base stations, cellular towers, wireless data networks, computers associated with wireless networks, etc. For example, wireless network 618 may include network management equipment that monitors the wireless signal strength of the wireless handsets (cellular telephones, handheld computing devices, etc.) that are in communication with network 618.

While certain embodiments have been described and shown in the accompanying drawings, it is to be understood that such embodiments are merely illustrative of and not restrictive on the broad invention, and that the invention is not limited to the specific constructions and arrangements shown and described, since various other modifications may occur to those of ordinary skill in the art. For example, although a speaker is specifically disclosed herein, the unibody piston and former disclosed herein could be used with other types of transducers, for example, microphones or other transducers (e.g., ambient pressure sensor). Still further, although a portable electronic device such as a mobile communications device is described herein, any of the previously discussed speaker configurations may be implemented within a tablet computer, personal computer, laptop computer, notebook computer and the like. The description is thus to be regarded as illustrative instead of limiting.

What is claimed is:

1. A unibody piston and former for a speaker, the unibody piston and former comprising:

a piston having a sound radiating portion and a transition portion, the transition portion having a first end portion and a second end portion, the first end portion extending from the sound radiating portion and forming a first interior angle with the sound radiating portion, the first interior angle is positioned higher than a lowest portion of the sound radiating portion, as defined along a vibration axis of the sound radiating portion, and less than one-hundred and eighty degrees; and a former extending from the second end portion of the transition portion, the former and the second end portion of the transition portion forming a second interior angle, and the former and the piston are a unibody structure.

2. The unibody piston and former of claim 1 wherein an interior surface of the sound radiating portion and an interior surface of the transition portion form the first interior angle, and the interior surfaces share a same acoustic volume as the former when the unibody piston and former are coupled to a speaker frame.

3. The unibody piston and former of claim 1 wherein the sound radiating portion comprises a substantially curved, concave shape.

4. The unibody piston and former of claim 1 wherein the sound radiating portion comprises a cone shape.

5. The unibody piston and former of claim 1 wherein the transition portion comprises a substantially planar profile and the first interior angle and the second interior angle are both between one-hundred degrees and one-hundred and fifty degrees.

6. The unibody piston and former of claim 1 wherein the first end portion of the transition portion is higher than the second end portion, and the transition portion comprises a downward slope in a direction of the former.

7. The unibody piston and former of claim 1 wherein the first interior angle is greater than ninety degrees.

8. The unibody piston and former of claim 1 wherein the second interior angle is between ninety degrees and one-hundred and eighty degrees.

9. The unibody piston and former of claim 1 wherein the piston is substantially horizontally oriented and the former is substantially vertically oriented.

10. The unibody piston and former of claim 1 wherein the first interior angle and the second interior angle in combination geometrically stiffen the piston so that it has a stiffness greater than a piston having a single angle formed therein.

11. The unibody piston and former of claim 1 wherein the transition portion comprises a substantially planar exterior surface extending between the first end portion and the second end portion, and a suspension member is attached to the exterior surface and couples the unibody piston and former to a frame.

12. The unibody piston and former of claim 1 wherein the piston and the former comprise a thermally conductive material suitable for transferring a heat generated by a voice coil attached to the former, to the piston and dissipating the heat away from the piston.

13. The unibody piston and former of claim 1 wherein the piston and former comprise a material selected from the group consisting of aluminum, titanium, stainless steel, aluminum alloy and magnesium alloy.

14. A speaker assembly comprising:

a piston having a first portion for radiating sound and a second portion that extends radially outward to the first portion, and the first portion and the second portion form a first angle that is less than one-hundred and eighty degrees and the first angle is positioned higher than a lowest portion of the piston, as defined along a vibration axis of the piston; and a former extending axially downward from an end of the second portion that is opposite the first portion, the former and the second portion forming a second angle that is greater than ninety degrees, and the former and the piston are formed of a same material.

15. The speaker assembly of claim 14 wherein the first angle is an interior angle formed by a curved interior surface of the first portion and a substantially planar interior surface of the second portion.

16. The speaker assembly of claim 14 wherein the first angle is between ninety degrees and one-hundred and fifty degrees.

17. The speaker assembly of claim 14 wherein the second angle is between one-hundred degrees and one-hundred and sixty degrees.

18. The speaker assembly of claim 14 wherein the piston and the former comprise a thermally conductive material suitable for transferring and dissipating heat.

19. The speaker assembly of claim 14 further comprising:

a suspension member directly attached to the second portion and suspending the piston and the former from a frame;

a voice coil positioned around the former; and a magnet assembly having a magnetic gap within which the voice coil is positioned, and wherein the magnet assembly comprises a recessed portion that is aligned with the first portion.

20. A speaker assembly comprising:

a frame;

a magnet assembly coupled to the frame, the magnet assembly forming an air gap through which a magnetic flux is directed and having a recessed region;

a one-piece structure having a horizontally oriented piston positioned over the magnet assembly and a vertically oriented former that extends into the air gap formed by the magnet assembly, and the piston and the former define a first interior angle and a second interior angle, the first interior angle and the second interior angle are greater than ninety degrees, and the first interior angle is positioned higher than a lowest portion of the piston, as defined along a vibration axis of the piston;

a voice coil coupled to the former; and a suspension member that couples the one-piece structure to the frame to allow a substantially vertical movement of the piston relative to the frame.

21. The speaker assembly of claim 20 wherein the first interior angle is formed between a sound radiating portion and a sloped perimeter portion of the piston.

22. The speaker assembly of claim 21 wherein the second interior angle is formed between the sloped perimeter portion of the piston and the former, and the second interior angle is between ninety degrees and one-hundred and sixty degrees.

23. The speaker assembly of claim 20 wherein the recessed region of the magnet assembly is aligned with a sound radiating portion of the piston.

24. The speaker assembly of claim 20 wherein the magnet assembly comprises an opening that is aligned with a sound radiating portion of the piston.

25. The speaker assembly of claim 20 wherein the one-piece structure is formed of a thermally conductive material and is operable to dissipate a heat generated by the voice coil.

26. The speaker assembly of claim 20 wherein the first interior angle and the second interior angle geometrically increase a stiffness of the piston in comparison to a piston without an interior angle greater than ninety degrees.

* * * * *